US006102601A

United States Patent [19]

Hu

[11] Patent Number: 6,102,601

[45] Date of Patent: Aug. 15, 2000

[54] INK CHAMBER PRESSURE ENHANCING CONTROL

[75] Inventor: Cho-Kai Hu, Shin-Tien, Taiwan

[73] Assignee: Pro Eton Corporation, Shin-Tien, Taiwan

[21] Appl. No.: 09/281,446

[22] Filed: Mar. 30, 1999

[51] Int. Cl.[7] ..... B43K 5/02

[52] U.S. Cl. ..... 401/188 R; 401/188 A

[58] Field of Search ..... 401/188 A, 188 R

[56] References Cited

U.S. PATENT DOCUMENTS 1,319,556 10/1919 Baker ..... 401/260
2,787,249 4/1957 Barlow et al. ..... 401/184
3,115,868 12/1963 De Molin et al. ..... 401/188 R
5,738,458 4/1998 Smith ..... 401/190

*Primary Examiner*—Henry J. Recla
*Assistant Examiner*—Peter deVore
*Attorney, Agent, or Firm*—Bacon & Thomas, PLLC

[57] ABSTRACT

An ink chamber pressure enhancing control device, which includes a valve block mounted in the barrel of a writing instrument above an ink chamber, a cap axially movably mounted in the valve block above a valve port in the valve block, the cap having an air inlet, a piston supported on a spring member above the ink chamber in the barrel, wherein the piston is forced upwards by the spring member to close the valve port, enabling an air chamber to be formed within the cap and the valve block above the valve port, and from the air inlet at the cap and the valve port is forced into the ink chamber in the writing instrument when the cap is depressed.

9 Claims, 3 Drawing Sheets

INK CHAMBER PRESSURE ENHANCING CONTROL

BACKGROUND OF THE INVENTION (a) Field of the Invention

The present invention relates to a writing instrument, and more specifically to an in chamber pressure enhancing control device for a writing instrument which can be pressed to increase the inside pressure of the ink chamber of the writing instrument.

(b) Description of the Prior Art

A writing instrument having an ink chamber in it is generally equipped with means for enhancing the inside pressure of the ink chamber. Japanese Utility Model No. 5-32235 discloses the use of a pen cap to force air into the ink chamber. The air inside the pen cap is compressed and forced through the writing tip into the ink chamber, when the pen cap is closed on the barrel of the writing instrument. If the inside pressure of the ink chamber is insufficient during writing, the user must stop writing, then attach the pen cap to the barrel of the writing instrument, and then start writing again after removal of the pen cap from the barrel. This operation procedure is complicated. Japanese Utility Model No. 60-90160 discloses a similar design. This design enables air to be forced through the writing tip into the ink chamber to increase the inside pressure of the ink chamber, when the pen cap is closed on the barrel of the writing instrument.

SUMMARY OF THE INVENTION

It is one object of the present invention to provide an ink chamber pressure enhancing control device for a writing instrument which can be operated to increase the inside pressure of the ink chamber, enabling ink to be smoothly guided out of the ink chamber for writing. It is another object of the present invention to provide an ink chamber pressure enhancing control device for a writing instrument which is operated by pressing a cap thereof to increase the inside pressure of the ink chamber. To achieve these and other objects of the present invention, there is provided an ink chamber pressure enhancing control device installed in the barrel of a writing instrument and controlled to enhance the pressure of an ink chamber defined in the barrel, the device comprising: a valve block mounted in the barrel of the writing instrument above the ink chamber, the valve block comprising a tubular top flange, a tubular bottom coupling portion fitted into the barrel of the writing instrument at the top, and an axially extended through hole having a narrow valve port; a cap mounted in the tubular top flange and moved up and down within the valve block above the valve port. the cap comprising an air inlet at the center of a top side wall thereof; a piston mounted inside the barrel of the writing instrument and inserted into the tubular bottom coupling portion of the valve and moved to close/open the valve port, the piston comprising a piston rod, which opens the air inlet at the cap when the valve port is closed by the piston, or closes the air inlet at the cap when the piston opens the valve port, and a stop flange raised around the periphery thereof, which is stopped below the bottom coupling portion of the valve block when the valve port is closed by the piston; and a spring member mounted inside the barrel of the ink chamber and stopped between the ink chamber and the stop flange of the piston; wherein the piston is forced upwards by the spring member to close the valve port, enabling an air chamber to be formed within the cap and the valve block above the valve port, and outside air is allowed to pass through the air inlet at the cap and the valve port into the ink chamber in the writing instrument when the cap is depressed.

DETAILED DESCRIPTION OF THE PREFERRED EMBODIMENT

Figure 1:
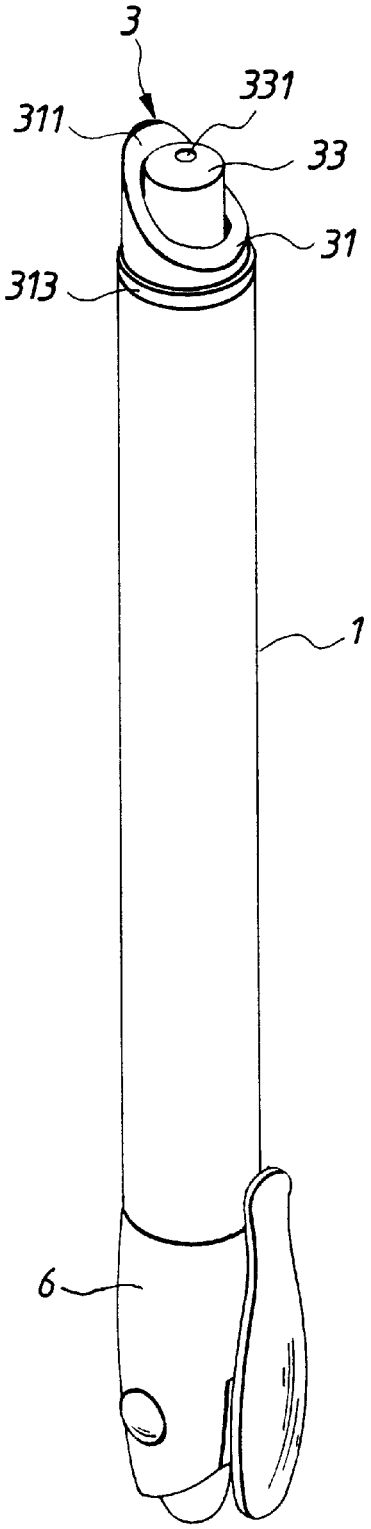
FIG. 1 illustrates an ink chamber pressure enhancing control device installed in the barrel of a writing instrument according to the present invention.
Figure 2:
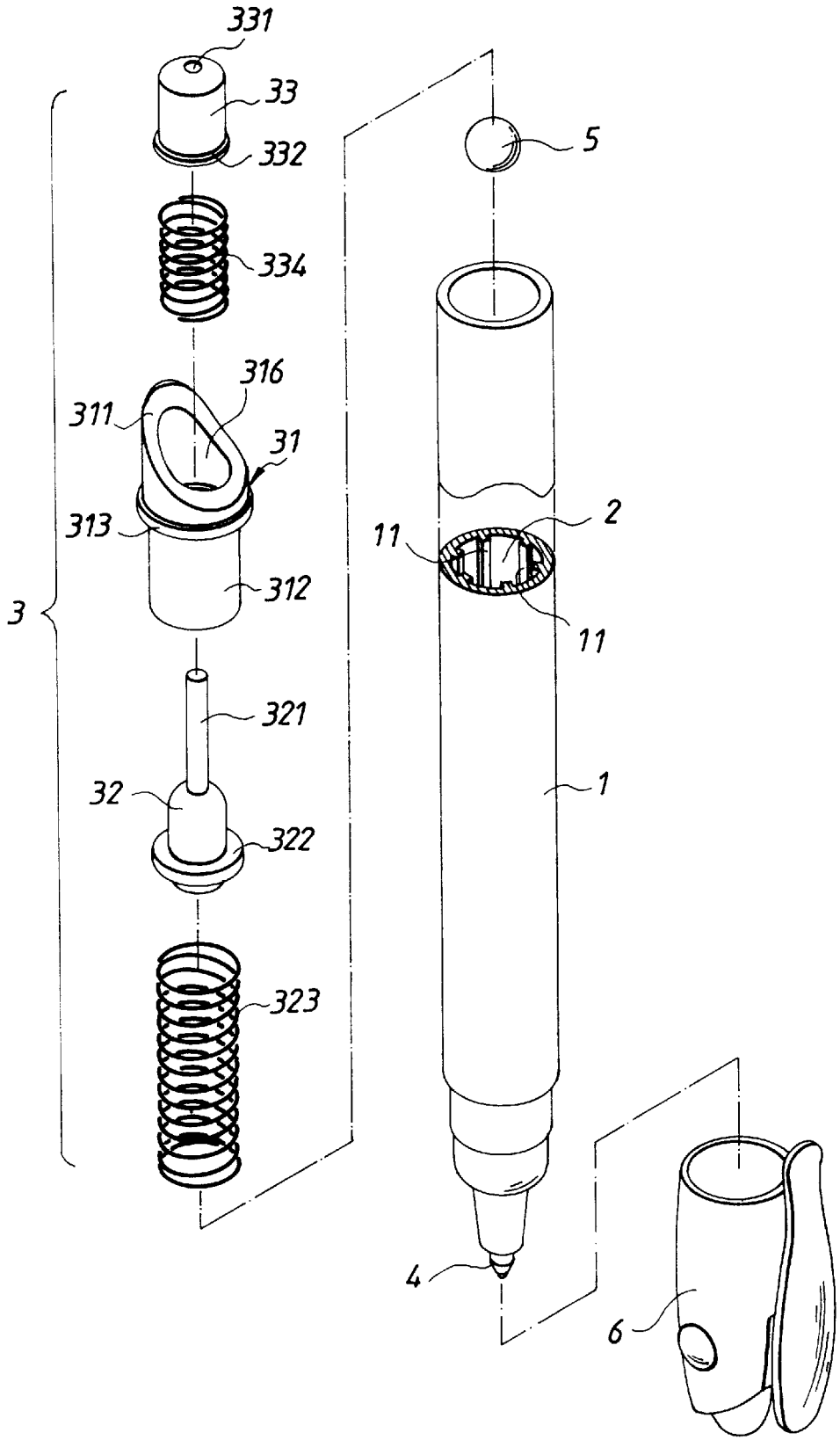
FIG. 2 is an exploded view of FIG. 1.
Figure 3:
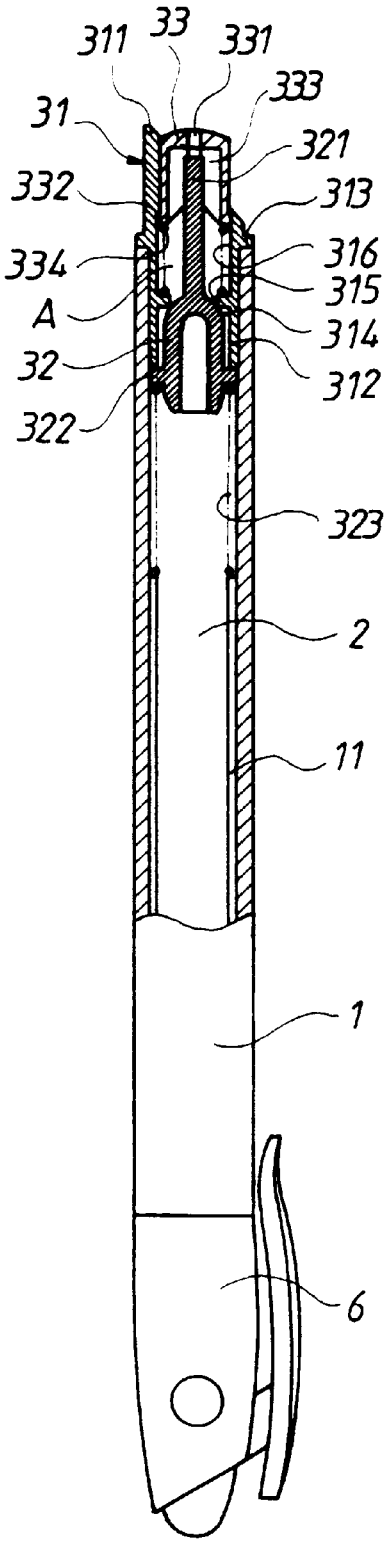
FIG. 3 is a sectional view of the present invention showing the valve port closed.

Referring to FIGS. 1 and 2, a writing instrument is shown comprising a barrel 1 having an ink chamber 2, and an ink chamber pressure enhancing control device 3 installed in the barrel 1 above the ink chamber 2. The ink chamber pressure enhancing control device 3 is comprised of a valve block 31, a piston 32, a cap 33, a first spring member 323, and a second spring member 334.

The valve block 31 comprises a tubular upper part terminating in a beveled top flange 311, a tubular bottom coupling portion 312, a collar 313 around the peripheral between the beveled top edge 31 and the bottom coupling portion 312, and an axially extended through hole, which is formed of a bottom opening 314 surrounded by the tubular bottom coupling portion 312, a top opening 316 surrounded by the beveled top flange 311, and a valve port 315 connected between the top opening 316 and the bottom opening 314. The diameter of the valve port 315 is relatively smaller than that of the top opening 316 and the bottom opening 314. The piston 32 is a cylindrical member having a piston rod 321 axially forwardly extended from the top center thereof, and a stop flange 322 extending around the bottom periphery thereof. The first spring member 323 is mounted on the piston 32 at the bottom side, and disposed between the ink chamber 2 and the stop flange 322. The cap 33 comprises an air inlet 331 at the center of the top side wall thereof, a bottom flange 332 extending around the periphery of the open bottom side thereof, and a plurality of axially extended inside ribs 333 around the inside wall thereof. The second spring member 334 is mounted within the top opening 316 inside the valve block 31, and stopped between the bottom flange 332 of the cap 33 and a part of the valve block 31 around the valve port 315.

The assembly process of the present invention is outlined hereinafter with reference to FIGS. 1 and 2 again. The first spring member 323 is inserted into the barrel 1 from the top and supported on inside ribs 11 at the ink chamber 2, then the piston 32 is inserted into the barrel 1 from the top and supported on the first spring member 333. Thereafter the tubular bottom coupling portion 312 of the valve block 31 is inserted into the top end of the barrel 1 with its collar 313 stopped above the barrel, and then the second spring member 334 is inserted into the top opening 316 and supported above the valve port 315. The cap 33 is finally mounted in the top opening 316 and supported on the second spring member 334. When assembled, the beveled top flange 311 of the valve block 31 is hammered inwards to stop the cap 33 from escaping out of the top opening 316 of the valve block 31. After installation, the piston rod 321 is inserted through the valve port 315 into the inside of the cap 33, and axially movably supported on the longitudinal inside ribs 333 in the cap 33. The piston 32 is forced upwards by the first spring member 323 to close the valve port 315, and an air chamber A is defined within the cap 33 above the valve port 315.

Through the air inlet 331, the air chamber A communicates with the outside.

Figure 4:
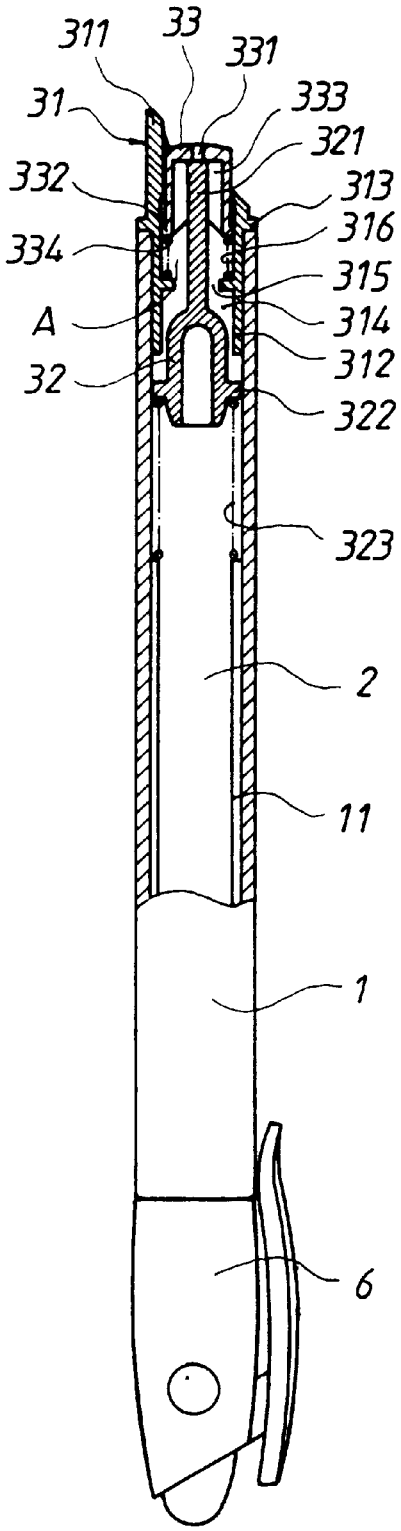
FIG. 4 is similar to FIG. 3 but showing the valve port opened.

Referring to FIG. 4, if the inside pressure of the ink chamber 2 is insufficient after a length of time in use, the cap 33 is pressed with the thumb to force the piston 32 downwards from the valve port 315, closing the air inlet 331 by the piston rod 321, and enabling the air chamber A to be communicated with the ink chamber 2. Thus, air is forced to flow from the air chamber A into the ink chamber 2. When the thumb is released from the cap 33, the cap 3 and the piston 32 are respectively pushed back to their former positions by the respective spring members 334 and 323, thereby opening inlet 331 and causing the valve port 315 to be closed by the piston 32 again. Therefore, the inside pressure of the ink chamber 2 can be gradually increased by continuously and alternatively pressing and releasing the cap 33, enabling ink to be smoothly guided out of the writing tip 4 of the writing instrument for writing. Further, the design of the beveled top flange 311 presents the cap 33 from being depressed accidentally.

Referring to FIG. 2 again, the stirring ball 5 is installed in the ink chamber 2. By shaking the barrel 1, the stirring ball 5 is forced to stir up the ink, thus enabling the ink to be guided out of the ink chamber 2 to the writing tip 4 smoothly. A pen cap 6 is provided for covering the front end of the barrel 1 to protect the writing tip 4 when the writing instrument is not in use.

While only one embodiment of the present invention has been shown and described, it will be understood that various modifications and changes could be made thereunto without departing from the spirit and scope of the invention disclosed.

What the invention claimed is:

1. An ink chamber pressure enhancing control device installed in the barrel of a writing instrument and controlled to enhance the pressure of an ink chamber defined in the barrel, the device comprising:

a valve block mounted in the barrel of the writing instrument above the ink chamber, the valve block including a tubular top flange, a tubular bottom coupling portion fitted into the barrel of the writing instrument at the top thereof, and an axially extended through hole having a narrow valve port;

a cap mounted in the tubular top flange of said valve block and movable up and down within said valve block above said valve port, said cap including an air inlet at the center of a top side wall thereof;

a piston mounted inside the barrel ofthe writing instrument and inserted into the tubular bottom coupling portion of said valve and movable to close/open said valve port, said piston including a piston rod, which opens the air inlet at said cap when said valve port is closed by said piston and closes the air inlet at said cap when said piston opens said valve port, and a stop flange extending around a bottom periphery of the piston, which stop flange engages the bottom coupling portion of said valve block when said valve port is closed by said piston;

a spring member mounted inside the barrel of the ink chamber and disposed between said ink chamber and the stop flange of said piston; and wherein said piston is forced upwards by said spring member to close said valve port, enabling an air chamber to be formed within said cap and said valve block above said valve port, and outside air passed through the air inlet at said cap and into the valve port may be forced into the ink chamber in the writing instrument when said cap is depressed.

2. The ink chamber pressure enhancing control device of claim 1, wherein the tubular top flange of said valve block has a beveled top edge.

3. The ink chamber pressure enhancing control device of claim 1 wherein said valve block includes a collar around the peripheral thereof and disposed above the barrel of the writing instrument.

4. The ink chamber pressure enhancing control device of claim 1 wherein the axially extended through hole of said valve block includes a top opening disposed above said valve port and surrounded by said tubular top flange.

5. The ink chamber pressure enhancing control device of claim 1 wherein said spring member is supported on ribs inside said ink chamber and disposed below the stop flange at said piston to impart an upward pressure to said piston.

6. The ink chamber pressure enhancing control device of claim 1 wherein said air chamber communicates with atmospheric pressure through said air inlet at said cap when the valve port is closed by said piston.

7. The ink chamber pressure enhancing control device of claim 1 wherein said cap includes a bottom flange extending around a bottom periphery thereof.

8. The ink chamber pressure enhancing control device of claim 1 wherein said cap includes a plurality of axially extended inside ribs that support the piston rod of said piston and guide the axial movement of said piston rod.

9. The ink chamber pressure enhancing control device of claim 1 further including a second spring member mounted in said valve block to support said cap above said valve port.

* * * * *